US009649750B2

(12) United States Patent
Bullard

(10) Patent No.: US 9,649,750 B2
(45) **Date of Patent: *May 16, 2017**

(54) JEWELRY MANDREL PLIERS AND METHOD OF USING SAME

(71) Applicant: Wubbers, LLC, Lubbock, TX (US)

(72) Inventor: Patricia Bullard, Lubbock, TX (US)

(73) Assignee: Wubbers, LLC, South Lake, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/985,781

(22) Filed: Dec. 31, 2015

(65) Prior Publication Data

US 2016/0114466 A1 Apr. 28, 2016

Related U.S. Application Data

(63) Continuation of application No. 13/491,755, filed on Jun. 8, 2012, now Pat. No. 9,227,304.

(60) Provisional application No. 61/494,705, filed on Jun. 8, 2011.

(51) Int. Cl.

| | |
|---|---|
| ***B25B 7/02*** | (2006.01) |
| ***B21D 53/44*** | (2006.01) |
| ***B21F 1/00*** | (2006.01) |

(52) U.S. Cl.

CPC ..... *B25B 7/02* (2013.01); *B21D 53/44* (2013.01); *B21F 1/002* (2013.01)

(58) Field of Classification Search

CPC . B21F 1/002; B21F 1/06; B21D 53/44; B25B 7/02; A44C 27/00; A45D 1/00; A45D 1/08; A45D 1/14

See application file for complete search history.

(56) References Cited

U.S. PATENT DOCUMENTS 1,268,922 A * 6/1918 Bryan ..... B21D 3/10 140/106

2010/0288085 A1* 11/2010 Carter ..... B25B 7/22 81/302

* cited by examiner

*Primary Examiner* — Debra Sullivan

(74) *Attorney, Agent, or Firm* — Vincent J. Allen; Stephen Y. Liu; Carstens & Cahoon, LLP

(57) ABSTRACT

The present invention provides a mandrel tool and method for more efficiently and consistently forming various shapes of material. In one embodiment of the invention, a pair of pliers having mandrel jaws that are shaped with a uniform cross sectional area throughout a length of the mandrel jaw is used to replace the traditional tapered mandrel. Because the mandrel jaws have a uniform cross sectional area, the wire, for example, can be wrapped multiple times around the mandrel jaw when it is desired to produce multiples of the same shape. For added versatility, the pliers can have opposing mandrel jaws, with different size cross sectional area.

9 Claims, 6 Drawing Sheets

JEWELRY MANDREL PLIERS AND METHOD OF USING SAME

CROSS-REFERENCE TO RELATED APPLICATIONS

This application is a continuation of U.S. Nonprovisional application Ser. No. 13/491,755, filed Jun. 8, 2012, and claims the benefit of U.S. Provisional Application No. 61/494,705, filed Jun. 8, 2011, which are all incorporated by reference in their entirety as examples.

BACKGROUND OF THE INVENTION

Technical Field

The present invention relates to a tool for manufacturing jewelry and a method of using such tool. More particularly, this invention relates to a jewelry mandrel constructed in the form of pliers and method, which can be used by jewelers to fabricate jewelry into various shapes.

Description of Related Art

Jewelers have long relied on tapered steel mandrels to fabricate wire or metal shapes for use in their jewelry designs. Tapered mandrels are available in cross sections of various shapes including round, square, triangle, oval, and hexagon. The mandrels are made of steel and provide a surface against which the jeweler can hammer to facilitate the shaping of the material being worked. The taper on the mandrel allows shapes of different sizes to be fabricated using a single mandrel. Although tapered steel mandrels are useful for certain tasks, they present the jeweler with challenges.

The taper on the mandrel makes it difficult to make shapes of the exact size when multiple items are being produced. The reason for this is that the circumference of the particular shape at issue has a tendency to stretch as it is worked on a tapered mandrel, particularly when working with wire. When making multiple items of the same size, each item must be formed one at time when it is made using a tapered mandrel. Because of the difficultly in placing the material in the exact same place on the tapered mandrel while hammering it into shape, the resulting shapes are often of a slightly different size.

To form a band from a strip of metal using a tapered mandrel, the band must frequently be removed and flipped so that the band does not become larger on one side than the other. The wider a particular band, the more difficult it becomes to keep both edges of the band the same size.

Moreover although a tapered mandrel can be used to produce a shape with sharp corners such a triangle or a square, it is not an easy task. The jeweler must first start with a closed ring or loop and then hammer it down around the mandrel until it produces a sharply defined shape. However, hammering a piece of soft wire or metal on a tapered mandrel often results in the shape being stretched beyond the circumference desired.

Finally, a tapered mandrel is awkward and is difficult to hold by hand. It can be placed in a large vise to hold it, but this method is time consuming and inconvenient. The vise also makes it difficult to obtain a good view of the entire piece in that the mandrel would need to be removed from the vise and rotated to obtain a good view of the back side of the mandrel.

It is therefore an object of the invention to provide a jewelry mandrel tool and method of using same that enables a user to easily, consistently, and repeatedly replicate the same shape and size. It is also an object of the invention to provide a tool for making numerous rings or other shapes in a more efficient manner and to provide a tool that makes it easier for the jeweler to view the work as it is being formed. It is an object of the invention to provide a tool that allows the wire or metal being formed to be gripped so that shapes can be made without the need for starting with a closed metal ring or tube.

SUMMARY OF AN EMBODIMENT OF INVENTION

The present invention provides a mandrel tool and method for more efficiently and consistently forming various shapes of material. In one embodiment of the invention, a pair of pliers having mandrel jaws that are shaped with a uniform cross sectional area throughout a length of the mandrel jaw is used to replace the traditional tapered mandrel. The mandrel pliers of the present invention may be used to grip wire or sheet metal and form it into unique shapes such as squares, triangles, ovals, or circles. Because the mandrel jaws have a uniform cross sectional area, the wire, for example, can be wrapped multiple times around the mandrel jaw when it is desired to produce multiples of the same shape. For added versatility, the pliers can have opposing mandrel jaws, each having a different size cross sectional area than the other so that a shape of a larger size can be created on one side of the pair pliers and a shape of a smaller size can be reproduced on the other side of the pair of pliers.

DETAILED DESCRIPTION

Figure 1:
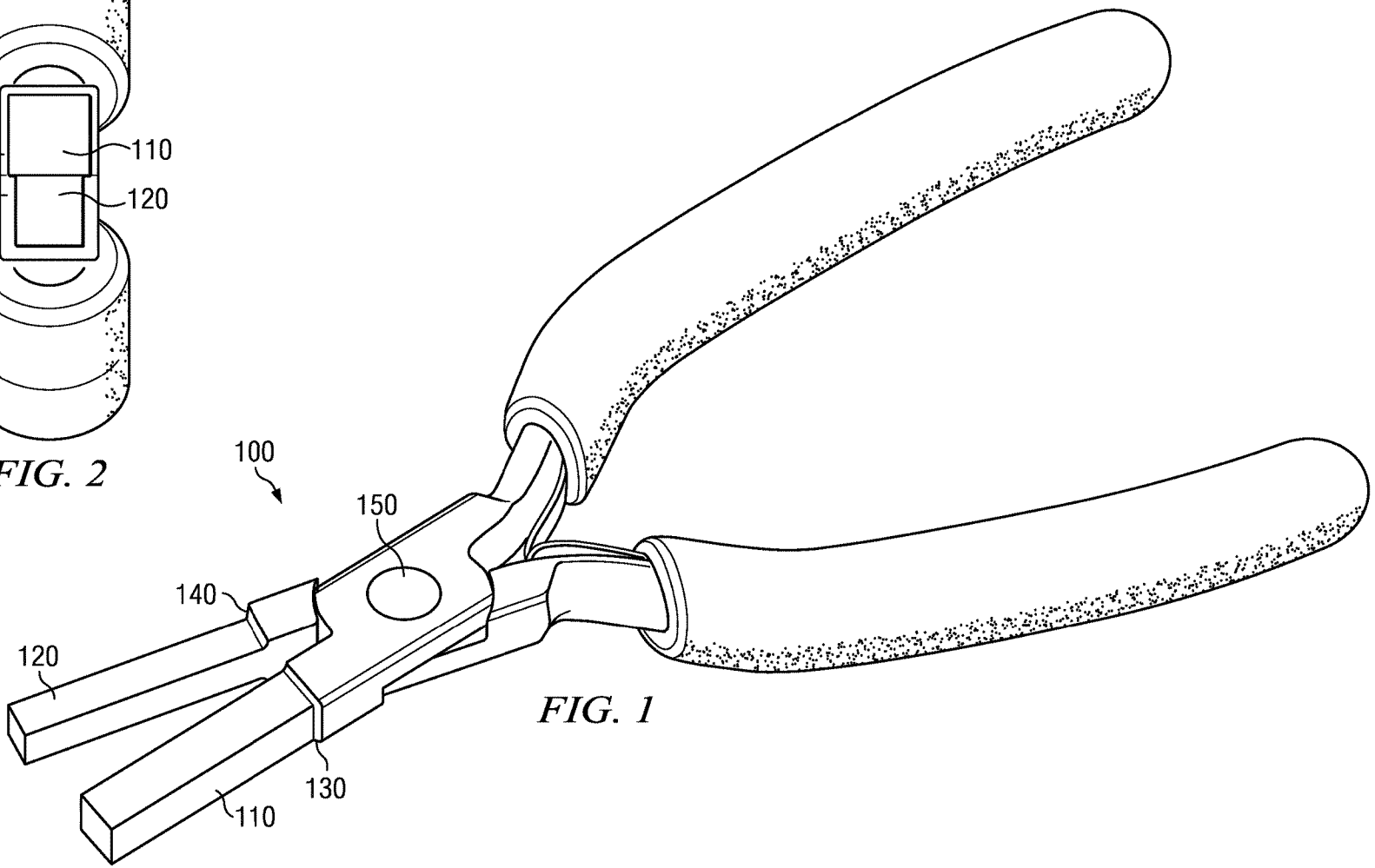
FIG. 1 is a perspective view of a pair of mandrel pliers in accordance with an embodiment of the present invention.

Referring now to FIG. 1, a perspective view of a pair of mandrel pliers in accordance with an embodiment of present is invention is illustrated. The pliers 100 have mandrel jaws 110, 120, each having a uniform square cross sectional area along a length from the tip of the mandrel jaw to the raised areas 130, 140 that are near the pivot 150 of the pliers 100. To allow more versatility for the pliers 100 and to require fewer pliers to be purchased by the jeweler to manufacture shapes of various sizes, the mandrel jaws 110, 120 can be constructed of different dimensions. As illustrated, the cross sectional area of the mandrel jaw 110 is larger than the cross sectional area of the opposing mandrel jaw 120.

Figure 2:
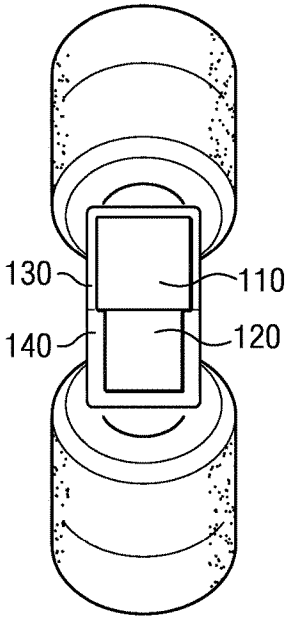
FIG. 2 is an end view of a pair of mandrel pliers in accordance with an embodiment of the present invention.
Figure 3:
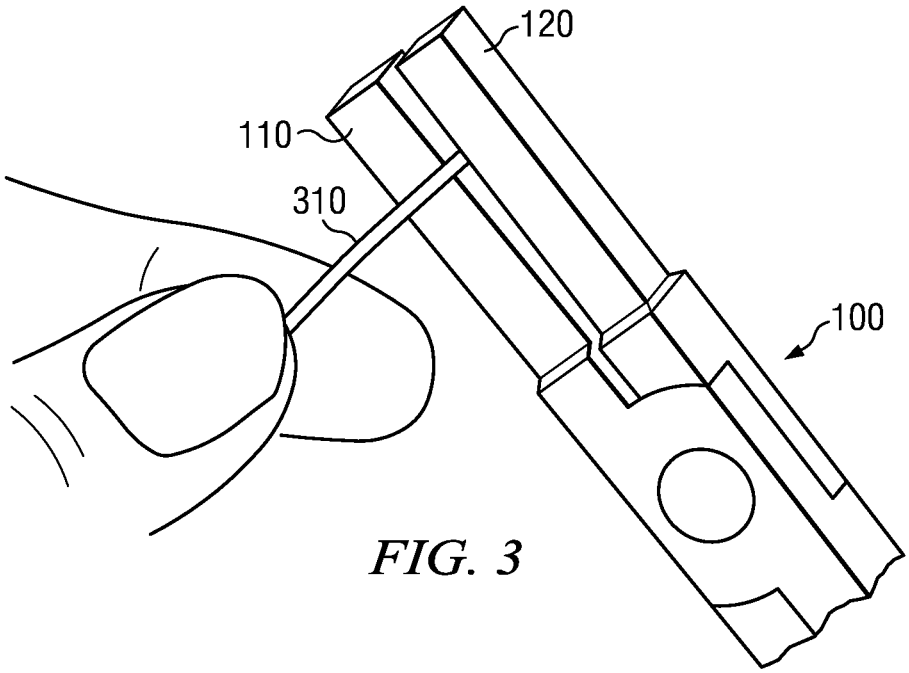
FIGS. 3-7 illustrate a method of using a pair of mandrel pliers to make a square jump ring in accordance with an embodiment of the invention.

Referring now to FIG. 2, an end view of a pair of mandrel pliers in accordance with an embodiment of the present invention is illustrated. The upper mandrel jaw 110 has a larger cross sectional area than the lower mandrel jaw 120.

Although mandrel jaws 110, 120 are illustrated in the form of square mandrels, various shapes can be utilized for the mandrel jaw 110, 120 without departing from the spirit and scope of the invention. For example, the mandrel jaws could be triangular, round, oval, rectangular, or any other shape that is desired by a jeweler for shaping jewelry. Additionally, the opposing jaws could each be a different shape. For example, one jaw could have a triangular cross section and the other jaw could have a square cross section.

Figure 4:
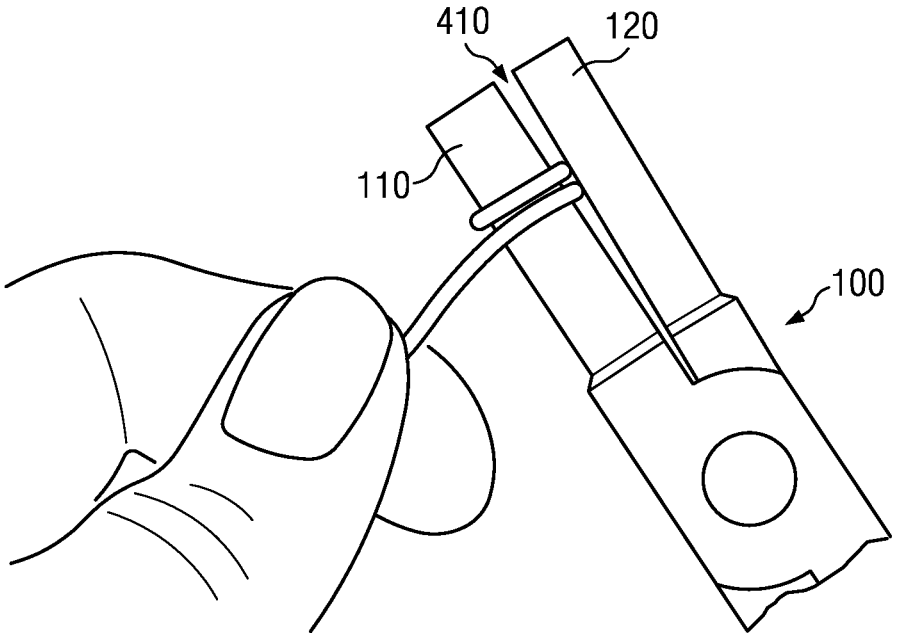
Figure 5:
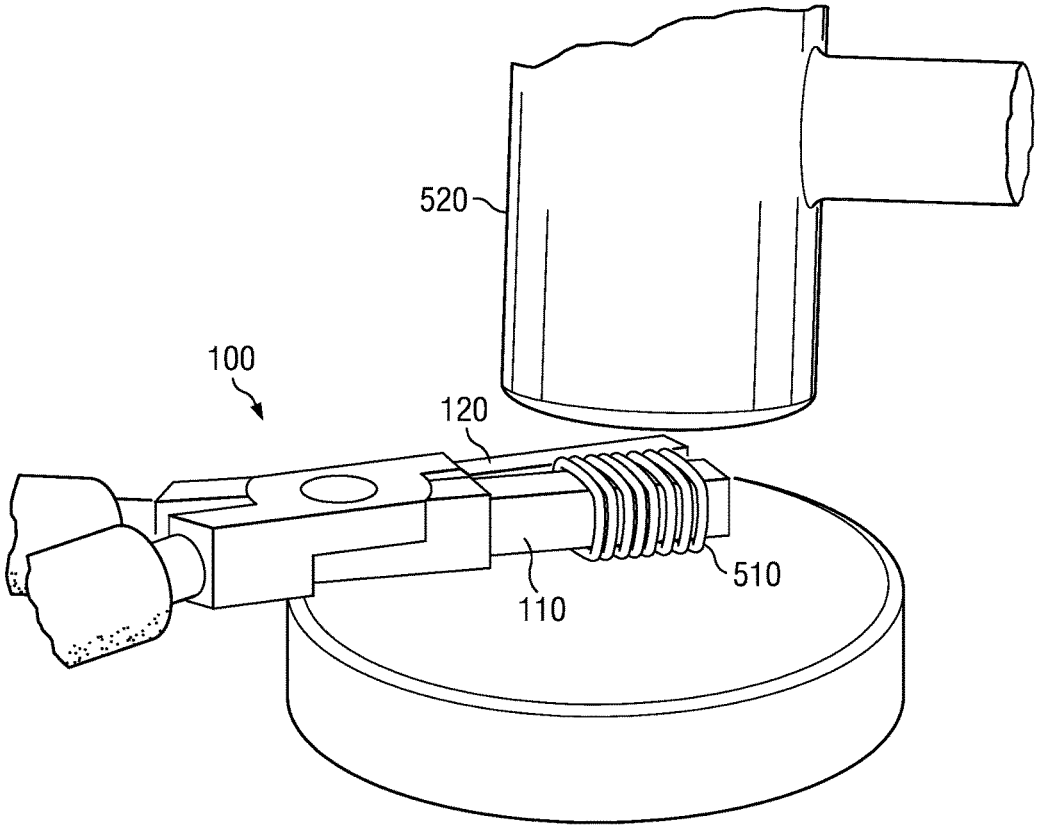
Figure 6:
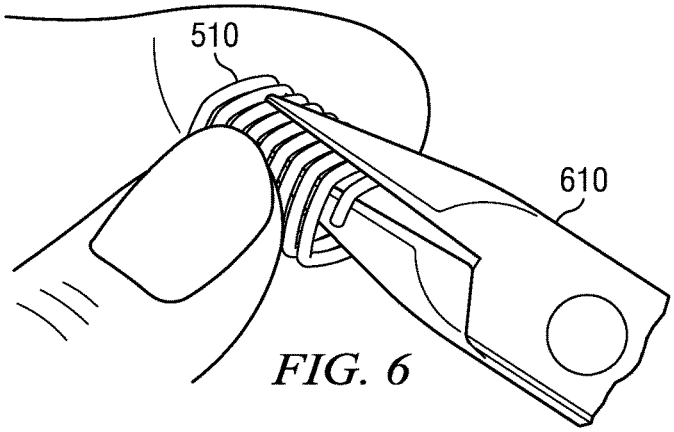
Figure 7:
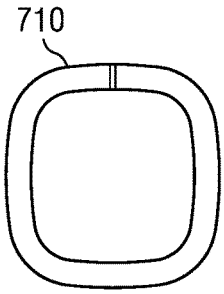

Referring now to FIGS. 3-7, a method of using the mandrel pliers 100 to make a square jump ring in accordance with an embodiment of the invention is illustrated. To make square jump rings (or links) with the pliers 100, the wire 310 is placed between the mandrel jaws 110, 120 and gripped firmly as the user wraps the wire 310 around the outside of the mandrel jaw 110 while pulling tightly on the wire 310. Once the wire is wrapped around to the opposing side of the mandrel pliers 100 the mandrel jaws 110, 120 are then opened by the user to allow the user to continue wrapping the wire around the mandrel jaw 110. Once the wire is placed through the space 410 between the mandrel jaws 110, 120, the user re-grips the wire and repeats the process pulling the wire tightly around the mandrel jaw 110 again as shown in FIG. 4. This process is continued until the desired number of wraps is reached. The bends of the coil 510 at the corners of the mandrel jaw 110 can be sharpened by hammering the three exposed sides of the coil directly onto the mandrel jaw 110 with a hammer 520 as shown in FIG. 5. After forming, the coil 510 is slid off of the mandrel jaw 110. The coil 510 can be used as is to make jewelry or the coil can be cut as shown in FIG. 6 to produce a square jump ring 710 as shown in FIG. 7.

Figure 8:
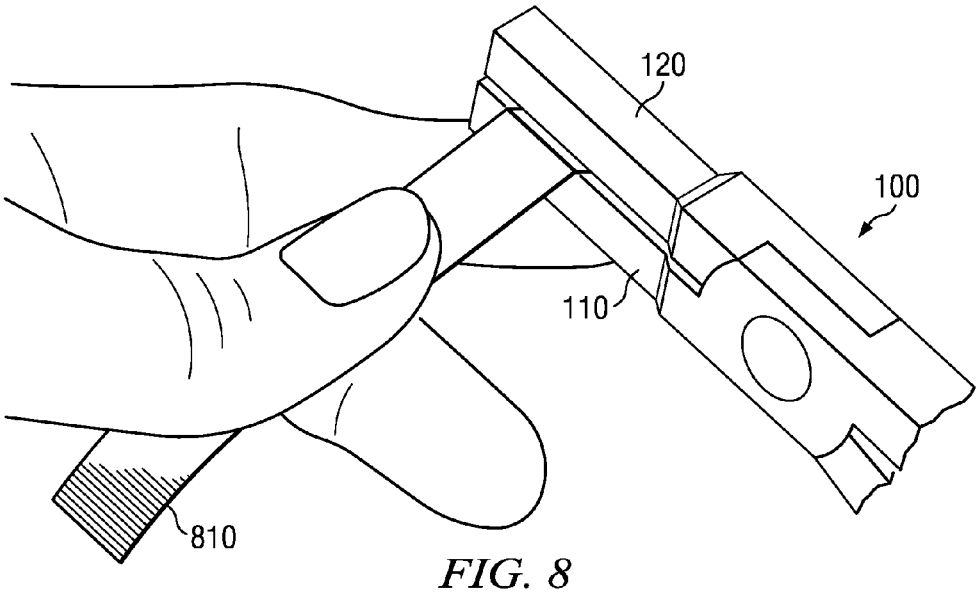
FIGS. 8-10 illustrate a method of using a pair of mandrel pliers to make a square tube in accordance with an embodiment of the invention.
Figure 9:
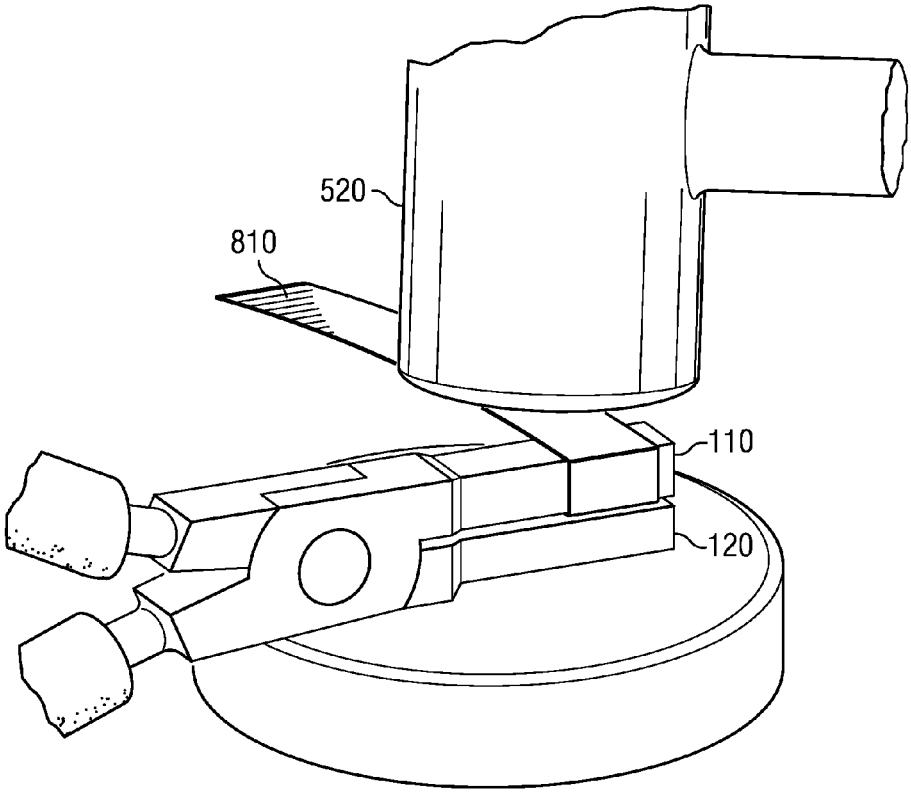
Figure 10:
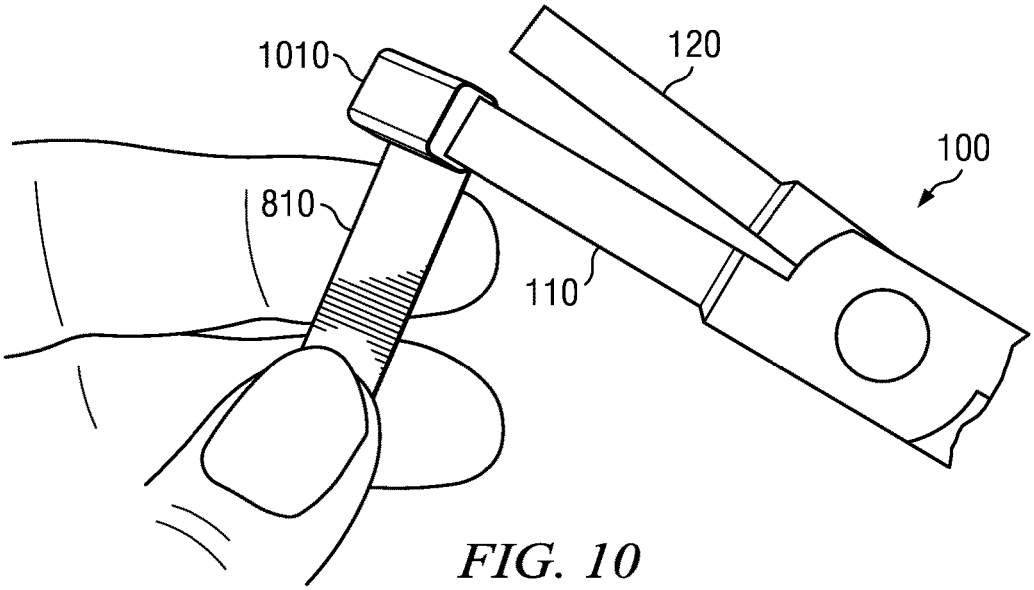

Referring now to FIGS. 8-10, a method of using the mandrel pliers 100 to make a square tube in accordance with an embodiment of the invention is illustrated. To make a square tube with the pliers 100, a strip of sheet metal 810 is placed between the mandrel jaws 110, 120 and gripped firmly as the user wraps the strip of sheet metal 810 around the outside of the mandrel jaw 110 while pulling tightly on the sheet metal 810. Depending on the thickness and flexibility of the sheet metal 810, it may be desirable to square each corner off more precisely by hammering directly on the mandrel jaw of the pliers after each bend as shown in FIG. 9. Once the formation of the sheet metal is completed, the square tube 1010 can be slid off the mandrel jaw 110 as shown in FIG. 10. The excess sheet metal 810 can then be trimmed adjacent to the square tube 1010. To complete the square tube, the joint may be soldered as is known in the art.

Figure 11:
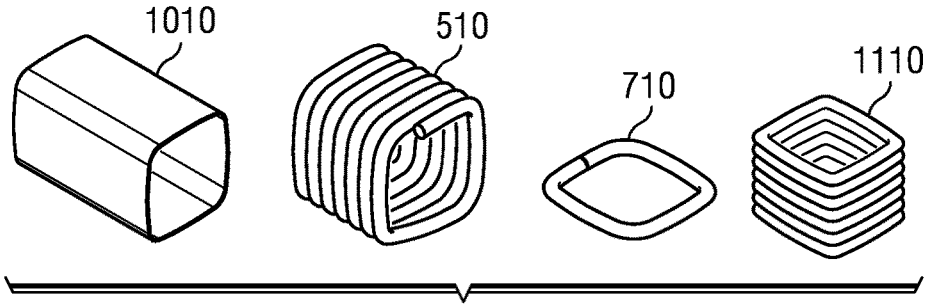
FIG. 11 is a perspective view of some examples of shapes that can be made using an embodiment of the mandrel pliers and method of the present invention.

Referring now to FIG. 11, some examples of shapes that can be made using the method of the present invention are illustrated. These shapes have many applications for a jewelry designer. The tubes can be soldered together to make big-hole beads or the jeweler can make bezels for setting stones or holding resin. A disk can also be soldered to each end of the tube to create matching hollow beads. The square coils can be linked together, fused, or soldered to make a fancy tube 1110. As previously discussed, the square coils can also be cut to make jump rings or links that can be flattened and textured with hammers.

Figure 12:
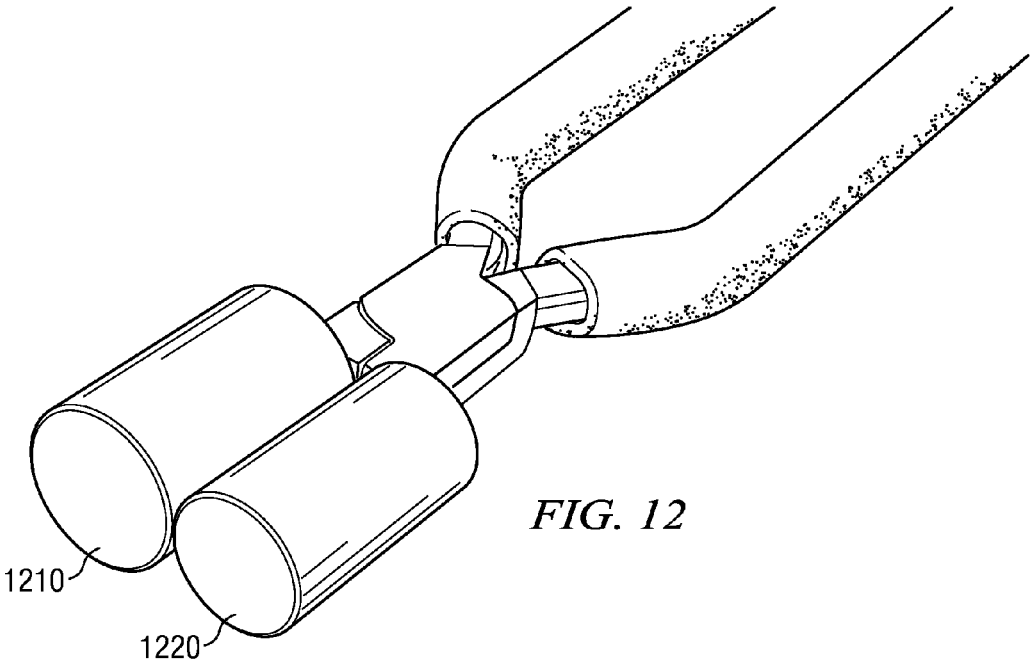
FIGS. 12-13 illustrate perspective views of mandrel pliers with oversized mandrel jaws.
Figure 13:
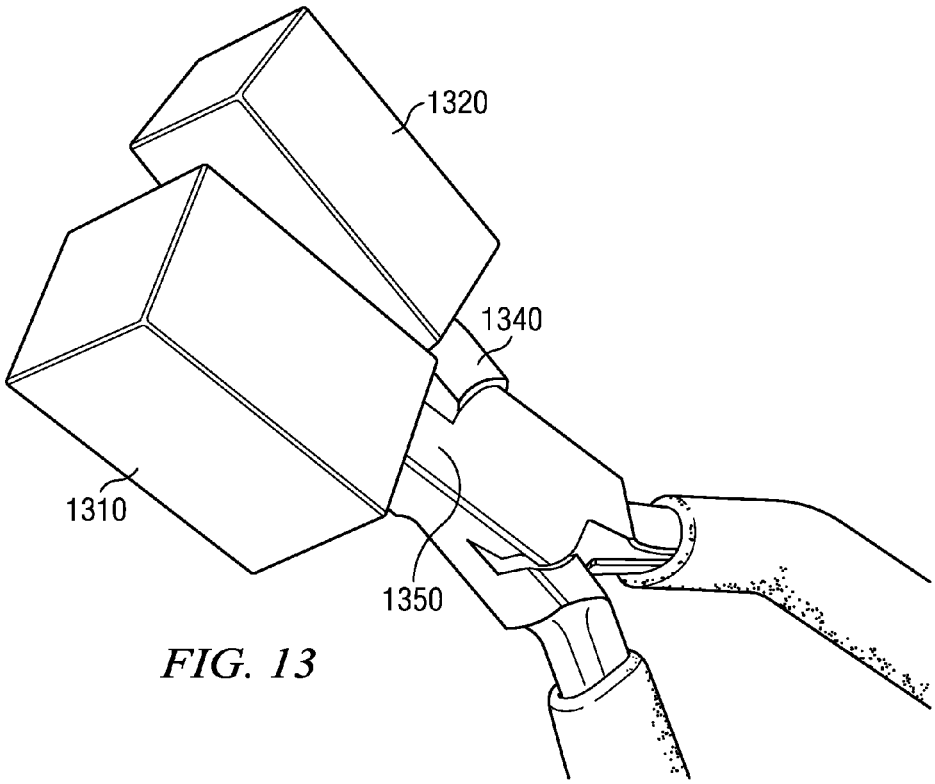

Referring now to FIGS. 12 and 13, perspective views of mandrel pliers with oversized mandrel jaws is illustrated. The pliers of FIG. 12 have oversized cylindrical jaws 1210, 1220. The jaws each have a different cross-sectional area to allow circular shapes of different sizes to be formed. Similarly, the pliers of FIG. 13 have oversized cylindrical jaws 1210, 1220. The jaws each have a different cross-sectional area to allow circular shapes of different sizes to be formed. Pliers with oversized jaws can be constructed by first forming the desired mandrel jaws 1320, 1310 and then welding the mandrel jaws to the ends 1340, 1350 of the plier handle assembly. The pliers of FIG. 1 can be formed by machining the mandrel jaws 110, 120 and one half of the plier assembly from a single piece of stock. Because of the large size of the mandrel jaws of the pliers illustrated in FIGS. 12 and 13, welding of the mandrel jaws to the plier assembly may be a more efficient method of manufacturing the pliers than machining would be.

The tool and method of the present invention thus provides an efficient and consistent method for a jeweler to make shapes using mandrels. When making shapes with sharp corners it is no longer necessary to join a loop together and form it by hammering it on a tapered mandrel. Because the loop can be left opened, the shapes can be more easily joined directly to each other before soldering them closed. A step is saved and finishing is easier because the jeweler does not have to cut the shape open and then re-solder. In addition, there are applications for open shapes to be used where it is not necessary to solder it closed, in which case, the step of cutting the formed link is saved.

The jeweler can make square, oval, circular, triangular, rectangular and other shapes in multiples rather than one at a time as is required when using a tapered mandrel. The jeweler can also maintain a consistent circumference of the shaped piece without having to flip the piece over repetitively as is required when working wired pieces of material on a tapered mandrel. A vise is no longer necessary because the jeweler can easily grip the material by hand using the mandrel pliers. The mandrel pliers allow the jeweler a good view of both the front and the back of the piece by changing the position of the handle on the pliers as the material is being worked. This makes it possible to wrap perfect coil in various shapes as desired by a jeweler.

Although the invention is described above and in the drawings using mandrel jaws of the same shapes, square, circular, etc., the invention is not limited to jaws of the same shape. For example, one jaw could be a square shape and the other rectangular. One could be triangular and the other circular. The mandrel jaws can also be chosen such that special shapes like hearts or teardrops can be formed. One jaw could be of a "v" or triangular shape that mates with an opposing heart shaped jaw to allow the formation of a crisp "v" or cleft in the top of the heart. Alternatively, one jaw could be of a "v" shape that mates with the bottom of the teardrop on a teardrop shaped opposing jaw. Numerous other shapes could also be formed with the mandrel pliers of the present invention by using various shapes on the jaws of the pliers.

Although the invention hereof has been described by way of a preferred embodiment, it will be evident that other adaptations and modifications can be employed without departing from the spirit and scope thereof. The terms and expressions employed herein have been used as terms of description and not of limitation; and thus, there is no intent of excluding equivalents, but on the contrary it is intended to cover any and all equivalents that may be employed without departing from the spirit and scope of the invention. For example, the shapes of the mandrel jaws could be any shape desired by the jeweler, including non-traditional shapes.

I claim:

1. A pair of mandrel pliers for forming metal during the manufacture of jewelry, said mandrel pliers comprising:

a first member having a first handle on a first proximal end of said first member and a first mandrel jaw on a first distal end of said first member;

a second member having a second handle on a second proximal end of said second member and a second mandrel jaw on a second distal end of said second member;

wherein said first member and said second member are attached at a connection point that divides the first member into the first proximal end and the first distal end, and divides the second member into the second proximal end and the second distal end;

wherein the first distal end and the second distal end comprise a distal length measured from the connection point to a terminal location at an end of the first and second distal ends;

wherein the first mandrel jaw extends almost entirely the distal length;

wherein the second mandrel jaw extends almost entirely the distal length;

wherein the connection point permits pivoting movement between said first mandrel jaw and said second mandrel jaw such that said first mandrel jaw and said second mandrel jaw are opposed and adapted for moving coplanarly with respect to each other in response to a squeezing force being applied to said first handle and said second handle, wherein said first mandrel jaw has a first uniform cross-sectional area throughout its length and wherein said second mandrel jaw has a second uniform cross-sectional area throughout its length, and wherein said first mandrel jaw and said second mandrel jaw are capable of securely gripping a material placed there between upon the application of said squeezing force to said first handle and said second handle by a user; and wherein the first uniform cross-sectional area is a triangle.

2. The pair of mandrel pliers of claim 1 wherein said first uniform cross sectional area is larger than a third cross-sectional area of a structure of the pliers to which said first mandrel jaw is attached.

3. The pair of mandrel pliers of claim 1, wherein said first mandrel jaw is attached to said first member of the pair of mandrel pliers by welding.

4. A pair of mandrel pliers for forming metal during the manufacture of jewelry, said mandrel pliers comprising:

a first member having a first handle on a first proximal end of said first member and a first mandrel jaw on a first distal end of said first member;

a second member having a second handle on a second proximal end of said second member and a second mandrel jaw on a second distal end of said second member;

wherein said first member and said second member are attached at a connection point that divides the first member into the first proximal end and the first distal end, and divides the second member into the second proximal end and the second distal end;

wherein the first distal end and the second distal end comprise a distal length measured from the connection point to a terminal location at an end of the first and second distal ends;

wherein the first mandrel jaw extends almost entirely the distal length;

wherein the second mandrel jaw extends almost entirely the distal length;

wherein the connection point permits pivoting movement between said first mandrel jaw and said second mandrel jaw such that said first mandrel jaw and said second mandrel jaw are opposed and adapted for moving coplanarly with respect to each other in response to a squeezing force being applied to said first handle and said second handle, wherein said first mandrel jaw has a first uniform cross-sectional area throughout its length and wherein said second mandrel jaw has a second uniform cross-sectional area throughout its length, and wherein said first mandrel jaw and said second mandrel jaw are capable of securely gripping a material placed there between upon the application of said squeezing force to said first handle and said second handle by a user; and wherein the first uniform cross-sectional area is triangular and said second uniform cross sectional area is heart shaped, and wherein said first mandrel jaw and said second mandrel jaw are oriented such that a corner of said first mandrel jaw can mate with a cleft in said second mandrel jaw to allow a heart-shaped piece to be formed with said mandrel pliers.

5. The pair of mandrel pliers of claim 4 wherein said first uniform cross sectional area is larger than a third cross-sectional area of a structure of the pliers to which said first mandrel jaw is attached.

6. The pair of mandrel pliers of claim 4, wherein said first mandrel jaw is attached to said first member of the pair of mandrel pliers by welding.

7. A pair of mandrel pliers for forming metal during the manufacture of jewelry, said mandrel pliers comprising:

a first member having a first handle on a first proximal end of said first member and a first mandrel jaw on a first distal end of said first member;

a second member having a second handle on a second proximal end of said second member and a second mandrel jaw on a second distal end of said second member;

wherein said first member and said second member are attached at a connection point that divides the first member into the first proximal end and the first distal end, and divides the second member into the second proximal end and the second distal end;

wherein the first distal end and the second distal end comprise a distal length measured from the connection point to a terminal location at an end of the first and second distal ends;

wherein the first mandrel jaw extends almost entirely the distal length;

wherein the second mandrel jaw extends almost entirely the distal length;

wherein the connection point permits pivoting movement between said first mandrel jaw and said second mandrel jaw such that said first mandrel jaw and said second mandrel jaw are opposed and adapted for moving coplanarly with respect to each other in response to a squeezing force being applied to said first handle and said second handle, wherein said first mandrel jaw has a first uniform cross-sectional area throughout its length and wherein said second mandrel jaw has a second uniform cross-sectional area throughout its length, and wherein said first mandrel jaw and said second mandrel jaw are capable of securely gripping a material placed there between upon the application of said squeezing force to said first handle and said second handle by a user; and wherein the first uniform cross-sectional area is v-shaped and said second uniform cross sectional area is teardrop shaped, and wherein said first mandrel jaw and said second mandrel jaw are oriented such that the inside of a v in the first mandrel jaw can mate with an acute angle of a teardrop of the second mandrel jaw to allow a teardrop shaped piece to be formed with the mandrel pliers.

8. The pair of mandrel pliers of claim 7 wherein said first uniform cross sectional area is larger than a third cross-sectional area of a structure of the pliers to which said first mandrel jaw is attached.

9. The pair of mandrel pliers of claim 7, wherein said first mandrel jaw is attached to said first member of the pair of mandrel pliers by welding.

* * * * *